US005707002A

United States Patent [19]

Miyamoto et al.

[11] Patent Number: 5,707,002

[45] Date of Patent: Jan. 13, 1998

[54] ENVELOPE FOR USE IN IMAGE FORMING APPARATUS

[75] Inventors: Toshio Miyamoto; Takahiro Inoue; Masahiro Goto; Koichi Suwa, all of Yokohama, Japan

[73] Assignee: Canon Kabushiki Kaisha, Tokyo, Japan

[21] Appl. No.: 669,984

[22] Filed: Jun. 21, 1996

Related U.S. Application Data

[63] Continuation of Ser. No. 155,861, Nov. 23, 1993, abandoned.

[30] Foreign Application Priority Data

Nov. 30, 1992 [JP] Japan ..... 4-341041
Nov. 10, 1993 [JP] Japan ..... 5-281197

[51] Int. Cl.[6] ..... B65D 27/00

[52] U.S. Cl. ..... 229/68.1

[58] Field of Search ..... 229/80, 80.5, 69, 229/92.1, 302, 68.1; 383/61, 63, 84, 211

[56] References Cited

U.S. PATENT DOCUMENTS

| | | | |
|---|---|---|---|
| 2,161,474 | 6/1939 | Klein | 229/80 |
| 2,205,529 | 6/1940 | Heywood | 229/80 |
| 2,209,601 | 7/1940 | Heywood | 229/80 X |
| 2,601,946 | 7/1952 | Heywood | 229/80 |
| 2,825,497 | 3/1958 | Hitt | 383/84 |
| 3,325,084 | 6/1967 | Ausnit | 383/63 X |
| 3,510,053 | 5/1970 | Focke | 229/80 X |
| 4,802,618 | 2/1989 | Seto et al. | 229/92.1 X |
| 4,824,261 | 4/1989 | Provost | 383/61 X |
| 4,927,271 | 5/1990 | Branson | 383/61 X |
| 5,064,071 | 11/1991 | Kerfoot, Jr. | 383/39 X |
| 5,113,555 | 5/1992 | Wilson et al. | 383/63 X |

*Primary Examiner*—Jes F. Pascua

*Attorney, Agent, or Firm*—Fitzpatrick, Cella, Harper & Scinto

[57] ABSTRACT

The present invention provides an envelope comprising an envelope body including a pair of sheet-shaped constructural pieces which provide a front surface and a back surface, respectively, and are connected to each other to form an opening at at least one side, and a fixing portion for preventing relative movement between the pair of sheet-shaped constructural pieces in a facial direction.

4 Claims, 10 Drawing Sheets

ENVELOPE FOR USE IN IMAGE FORMING APPARATUS

This application is a continuation of application Ser. No. 08/155,861 filed Nov. 23, 1993, now abandoned.

BACKGROUND OF THE INVENTION

1. Field of the Invention

The present invention relates to an envelope used in an image forming apparatus such as a copying machine, a laser beam printer and the like, and is conveyed by a pair of rollers.

2. Related Background Art

Examples of conventional envelopes used in an image forming apparatus such as a laser beam printer, a copying machine and the like are shown in FIGS. 11A and 11B and FIGS. 13A and 13B. In these Figures, an envelope 100 comprises a pair of constructural pieces (paper portions) 101, 102 providing front and back surfaces of the envelope, respectively, and a flap portion 103 on which an adhesive for sealing the envelope is coated. There are various kinds of envelopes having different sizes and configurations, and typical envelopes are shown in FIGS. 11A, 11B and 13A, 13B. The envelope shown in FIGS. 11A and 11B is usually used in the United States and Europe and is referred as "COM10" (the United States) and "DL" (Europe), in which the flap portion (opening portion) 103 is positioned along one of longer edges of the rectangular envelope. On the other hand, the envelope shown in FIGS. 13A and 13B is usually used in Japan in which the flap portion 103 is positioned along one of shorter edges of the rectangular envelope.

When characters are printed on the envelope by the image forming apparatus, generally, the envelope is inserted into the image forming apparatus while registering the longer edges of the rectangular envelope in a longitudinal direction.

Further, in order to improve the reliability, as shown in FIG. 12, a typical conventional fixing device comprises a rigid fixing roller 104, and a pressure roller (rubber roller) 105 having an elastic layer at its outer surface. The envelope 100 is pinched by these rollers 104, 105 and is conveyed in a direction shown by the arrow by the rotation of the rollers.

However, in the above-mentioned conventional fixing device, there arose a problem that wrinkles are formed on the envelope shown in FIGS. 11A and 11B when the envelope is passed through the fixing device. That is to say, since the fixing device comprises the (drivel rigid fixing roller and the (driven) pressure roller or rubber roller having the elastic outer layer, there arises the difference in convey speed between the front and back paper portions of the envelope, thereby creating the wrinkles. The principle of why the wrinkles are created will be described later.

FIG. 14 shows a condition that the envelope is inserted into the fixing device while registering the longer edges of the rectangular envelope in the longitudinal direction. In this envelope, since the front and back paper portions 101, 102 are connected to each other only along one edge of the envelope (one side opposite to the flap portion), the convey speed differences between the front and back paper portions are gradually accumulated, thereby creating the wrinkle 106 at the trailing end of the envelope.

Now, the principle of why the wrinkle is created will be explained. When an angular velocity of the fixing roller 104 is ω and a thickness of each of front and back paper portions 101, 102 is t, a convey speed $V_{P1}$ of the paper portion 101 is expressed by the following equation:

$$V_{P1}=R_1\cdot\omega=[R+(1/2)t]\cdot\omega$$

Similarly, a convey speed $V_{P2}$ of the paper portion 102 is expressed by the following equation:

$$V_{P2}=R_2\cdot\omega=[R+(3/2)t]\cdot\omega$$

Where, R is a radius of the fixing roller 104. Accordingly, there arises a relative convey speed difference between the front and back paper portions 101 and 102, and thus, the back paper portion 102 is conveyed faster than the front paper portion 101 by the following amount:

$$t/[R+(2/2)t]\times100\% =(t/R)\times100\%.$$

Consequently, the convey speed differences are accumulated at the trailing end of the envelope, thereby creating the wrinkle in the back paper portion 102.

For example, when a length of the envelope is 200 mm, the thickness of the envelope is 0.1 mm and the radius R of the fixing roller is 10 mm, the convey amount difference between the front and back paper portions becomes 2 mm or more. This can be ascertained by pinching two overlapped normal paper sheets between the rollers of the fixing device and by measuring the convey amount difference between the sheets. In order to solve the above problem, the radius R of the fixing roller 104 may be increased. In this case, however, since the image forming apparatus becomes large-sized and expensive, the radius of the fixing roller cannot be increased infinitely.

SUMMARY OF THE INVENTION

The present invention aims to eliminate the above-mentioned conventional drawback, and an object of the present invention is to provide an envelope wherein convey amounts of a pair of paper portions of the envelope can be equalized when the envelope is pinched and conveyed by a pair of rollers.

In order to achieve the above object, according to the present invention, there is provided an envelope comprising a pair of paper portions providing front and back surfaces of the envelope pinched and conveyed by a pair of rollers having different rigidity and wherein a fixing means for preventing a relative movement between the pair of paper surfaces in a facial direction is provided on the envelope.

The fixing means may be peelable from the envelope. When the fixing means is constituted by an adhesive tape adhered to the pair of paper portions of the envelope, the paper portions are fixed in the facial direction by an adhering force of the tape. When the fixing means is constituted by a pair of friction members having projections and recesses engaged by each other, the pair of paper portions are fixed in the facial direction by an engagement force of the friction members. When the fixing means is constituted by an adhesive, the pair of paper portions are fixed in the facial direction by an adhering force of the adhesive.

When the envelope is pinched by a pair of rollers and is conveyed by the rotation of the rollers, since the roller having smaller rigidity is deformed, the envelope is closely contacted with the roller having greater rigidity so that the envelope is curved in an arcuated form. Although an angular velocity of the inwardly positioned paper portion differs from an angular velocity of the outwardly positioned paper portion, since paper portions are fixed in the facial direction by the fixing means, the convey amounts of the pair of paper portions becomes the same.

DETAILED DESCRIPTION OF THE PREFERRED EMBODIMENTS

Figure 1A:
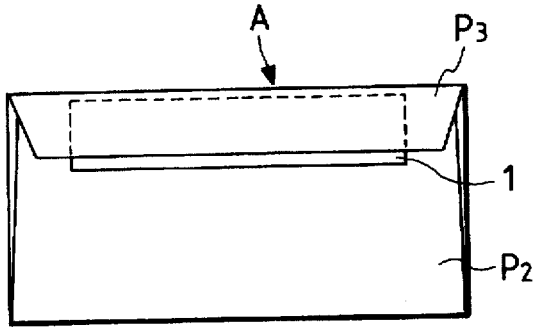
FIGS. 1A and 1B are plan views of an envelope according to a first embodiment of the present invention.
Figure 1B:
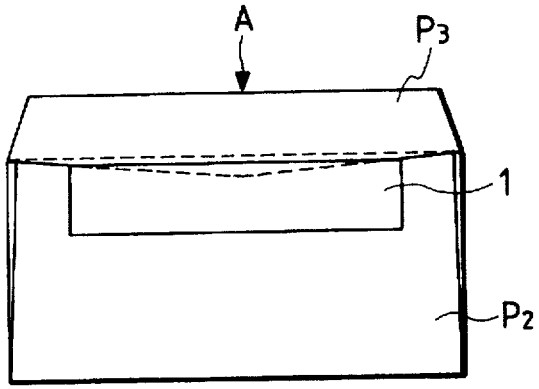
Figure 1C:
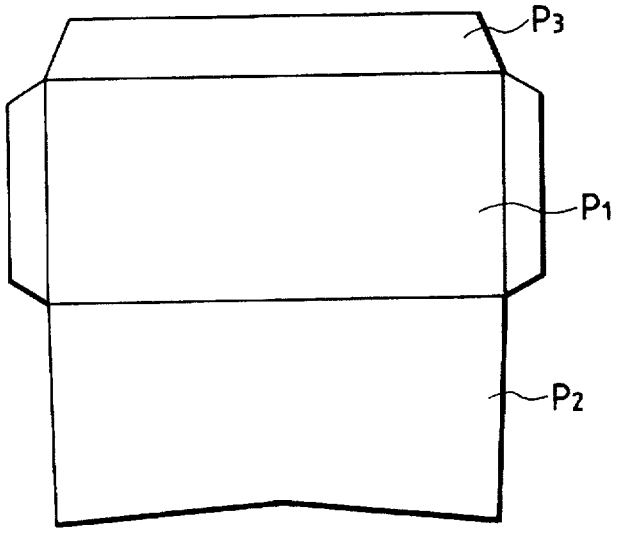
FIG. 1C is a development view of the envelope.

First of all, a first embodiment of the present invention will be explained with reference to FIGS. 1A to 1C, 2 and 3. FIGS. 1A to 1C are plan views of an envelope A according to the first embodiment, viewed from the back side.

Figure 2:
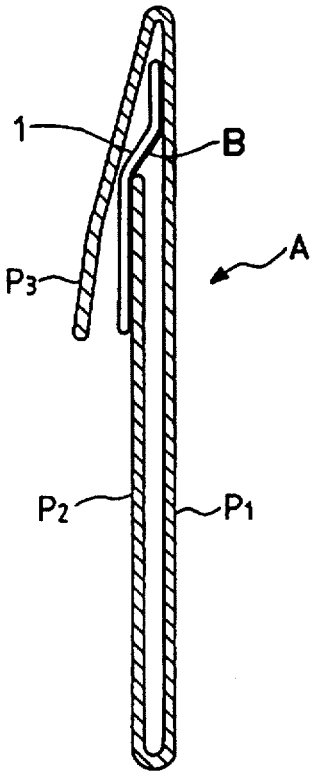
FIG. 2 is a sectional view of the envelope of FIGS. 1A to 1C.

A discrepancy preventing tape 1 acts as a peelable fixing member which is constituted by an adhesive tape having a predetermined adhere surface B in the illustrated embodiment. The discrepancy preventing tape 1 is adhered to the envelope below and on an inner side of a flap $P_3$ to hold a back surface $P_2$ and a front surface $P_1$ together, which surfaces $P_1$, $P_2$ constitutes a pair of constructural pieces (paper portions) of the envelope. FIG. 1B is a view of the envelope A with the flap $P_3$ being opened, looked at from the back side of the envelope, to clearly show the discrepancy preventing tape 1 in its adhered condition. FIG. 1C is a development view of the envelope. FIG. 2 is a sectional view of the envelope, where the adhere surface of the tape for holding the back surface $P_2$ and the front surface $P_1$ together is shown by the thick black line.

Figure 3:
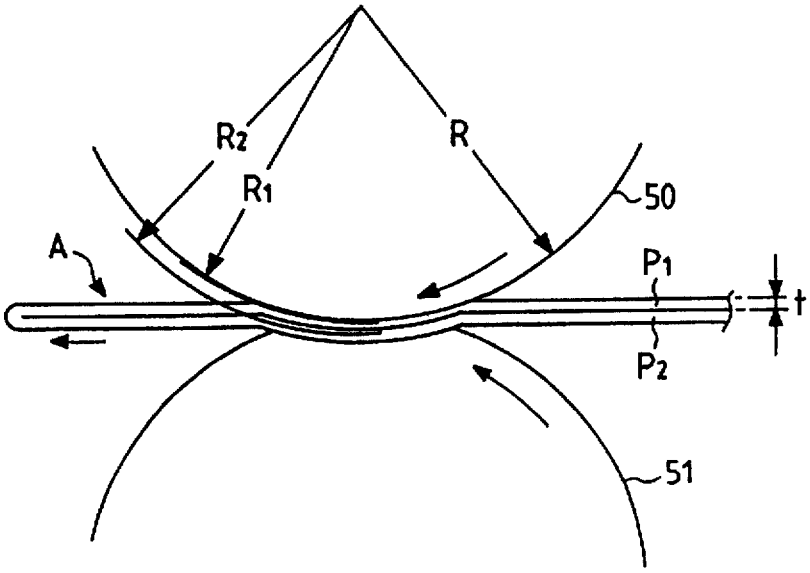
FIG. 3 is a side view of a portion of the envelope being conveyed.

FIG. 3 shows a condition that the envelope A is being passed .through a fixing device of a copying machine. The fixing device comprises a (drive) fixing roller 50 having high rigidity (for example, made of metal), and a (driven) pressure roller 51 having low rigidity (for example, made of elastic material such as rubber. The envelope A is pinched between the rollers 50, 51 and is conveyed by the rotation of the rollers.

When the envelope A is pinched between the paired rollers 50, 51 and is conveyed by the rotation of the rollers, since the roller 51 having low rigidity is deformed, the envelope is closely contacted with the roller 50 having high rigidity so that the envelope is curved in an arcuated form.

Now, when an angular velocity of the fixing roller 50 is ω and a thickness of each of front and back surfaces $P_1$, $P_2$ is t, a convey speed $V_{P1}$ of the front surface $P_1$ is expressed by the following equation:

$$V_{P1}=R_1\cdot\omega=[R+(1/2)t]\cdot\omega$$

Similarly, a convey speed $V_{P2}$ of the back surface $P_2$ is expressed by the following equation:

$$V_{P2}=R_2\cdot\omega=[R+(3/2)t]\cdot\omega$$

Where, R is a radius of the fixing roller 104.

Figure 4:
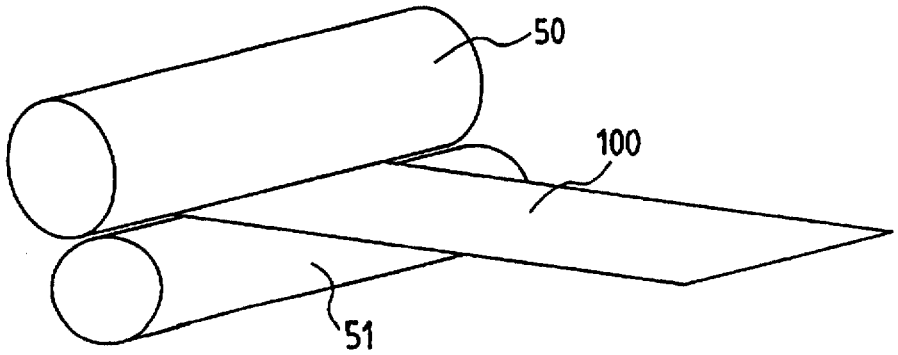
FIG. 4 is a perspective view showing a condition that the envelope is being conveyed.

However, in this case, since the front surface $P_1$ and the back surface $P_2$ are fixed to each other by the discrepancy preventing tape 1 so that these surfaces are not displaced relative to one another in a facial direction, the actual convey amount of the front surface becomes the same as the actual convey amount of the back surface. Accordingly, no wrinkles are created in the envelope A. This condition is shown in FIG. 4.

As in the conventional case, although the fixing device comprises the (drive) rigid fixing roller and the (driven) pressure roller having the elastic outer layer (made of rubber), since there is no difference in convey speed between the front surface and the back surface by virture of the technical effect of the present invention, no wrinkle is created. Further, the contamination and/or deviation of an image printed on the envelope A can be prevented. It was found that these advantages were noticeable particularly in a wetted envelope. The advantages are obtained by eliminating the difference in convey amount between the front surface $P_1$ and the back surface $P_2$ by the discrepancy preventing tape, unlike conventional envelopes.

After printing, the discrepancy preventing tape 1 is removed from the envelope, the contents are inserted into the envelope, and the envelope is then sealed. Thus, the operability of the envelope according to the present invention is not inferior to that of the conventional envelope at all.

Incidentally, in the illustrated embodiment, while the discrepancy preventing tape 1 was formed from a Menting Tape 810 and synthetic rubber of acrylic rubber group including adhesive (component) of synthetic rubber group and dispersed in organic solvent so that the tape can be adhered to and peeled from the envelope, the discrepancy preventing tape is not limited to the above, but may be any equivalent tape.

Incidentally, in the illustrated embodiment, while the adhesive tape was used as the peelable fixing member, the fixing member is not limited to the adhesive tape, but any peelable adhesive (for example, "spray paste 55" (adhesive of synthetic rubber group) manufactured by 3M) may be applied to the front and back surfaces $P_1$, $P_2$ to obtain the same technical effect.

Next, a second embodiment of the present invention will be explained.

Figure 5A:
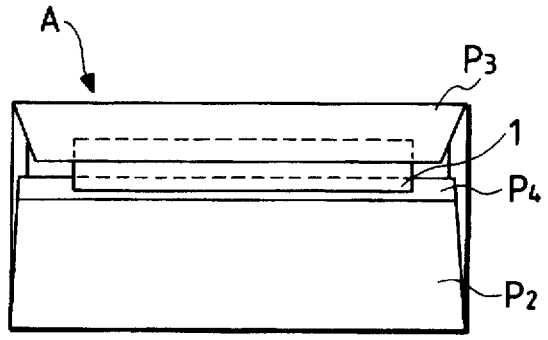
FIGS. 5A and 5B are plan views of an envelope according to a second embodiment of the present invention.
Figure 5B:
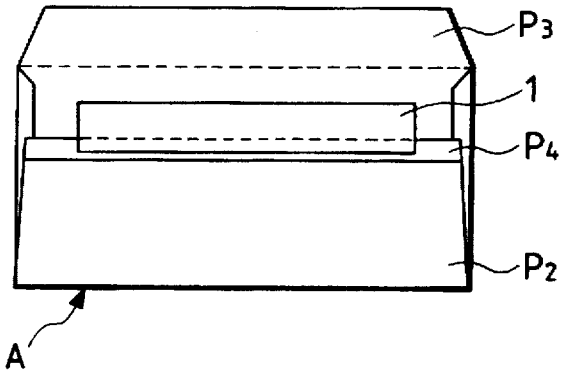
Figure 5C:
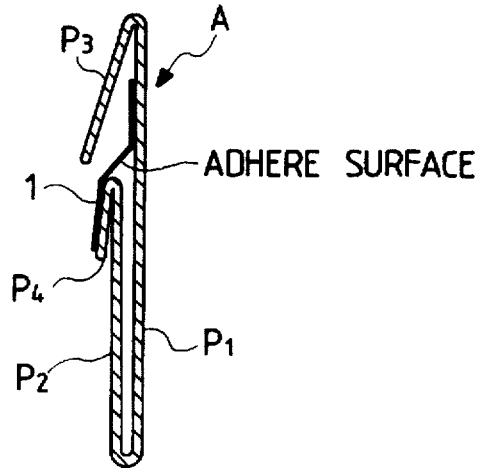
FIG. 5C is a sectional view of the envelope.

FIGS. 5A to 5C show an envelope of double flap type. The characteristic of the double flap envelope is that, in addition to the above-mentioned flap $P_3$, another flap $P_4$ is also formed by folding back an upper edge portion of the back surface $P_2$. Since the double flap envelop A has the complicated construction as mentioned above, wrinkles, deviation of the image and/or contamination of the image are very likely to be generated when the envelope is passed through the fixing device.

However, in accordance with the present invention, since the difference in convey amount between the front surface $P_1$ and the back surface $P_2$ is eliminated by adhering the discrepancy preventing tape 1 to the envelope to hold the front and back surfaces $P_1$, $P_2$ together via the flap P, the wrinkles, deviation of the image and contamination of the image can be prevented completely.

Figure 6A:
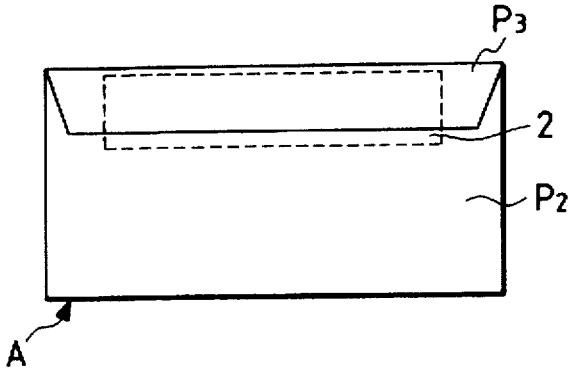
FIGS. 6A to 6C are plan views of an envelope according to a third embodiment of the present invention.
Figure 6B:
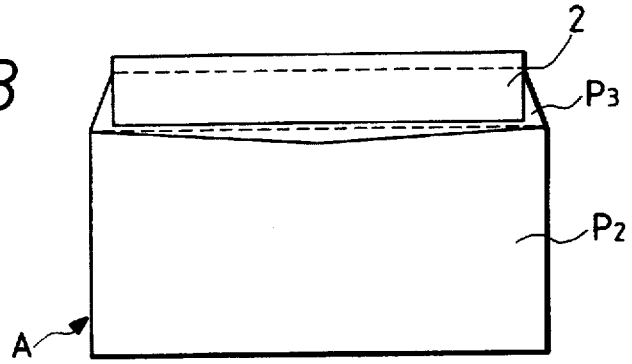
Figure 6C:
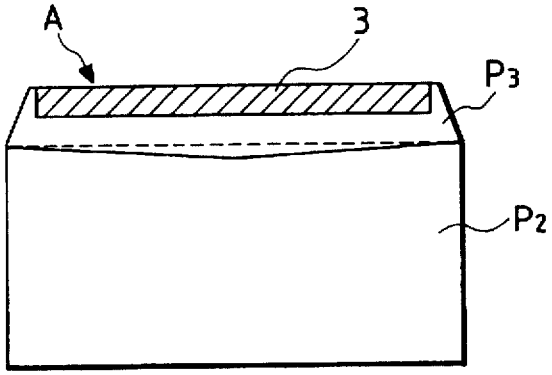
Figure 6D:
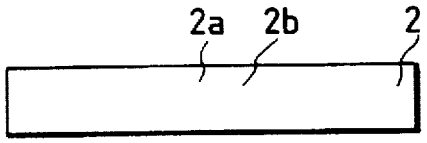
FIG. 6D is a plan view of a discrepancy preventing tape associated with the envelope of the third embodiment.
Figure 7:
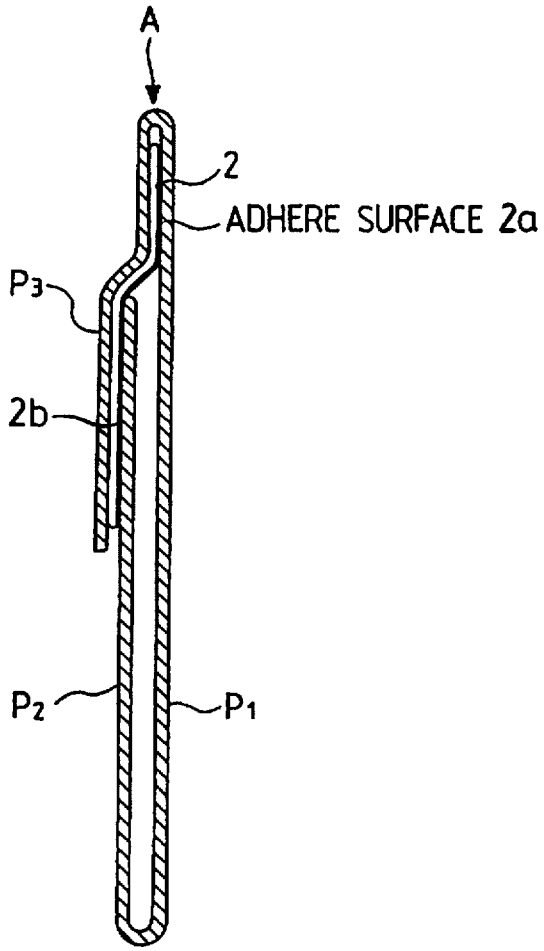
FIG. 7 is a sectional view of the envelope of FIGS. 6A to 6D.

Next, a third embodiment of the present invention will be explained with reference to FIGS. 6A to 6D and 7. Incidentally, the same or similar elements as those of the first embodiment are designated by the same reference numerals and the detailed explanation thereof will be omitted. FIG. 6A is a plan view of an envelope according to the third embodiment, looked at from the back side, FIG. 6B is a plan view of the envelope with an opened flap, looked at from the back side, and FIG. 6C is a plan view of the envelope with a discrepancy preventing tape 2 removed, looked at from the back side.

In this embodiment, a seal portion 3 for finally sealing the envelope is formed on a flap $P_3$ by coating an adhesive on the flap. On the other hand, the discrepancy preventing tape 2 has a smooth surface 2*b* (opposed to the closed flap 3) for covering the seal 3, and a peelable adhere surface 2*a* for preventing the discrepancy between a front surface $P_1$ and a back surface $P_2$. By this adhere surface 2*a*, the back surface $P_2$ and the front surface $P_1$ are held together. Accordingly, in this embodiment, the single discrepancy preventing tape has two functions (seal cover and discrepancy prevention).

According to this embodiment, during the printing, as shown in FIG. 6A, when the flap $P_3$ is bent or folded, since the back surface $P_2$ and the front surface $P_1$ are held together, there is no difference in convey amount between the back surface and the front surface, thereby preventing the occurrence of the wrinkles, deviation of the image and contamination of the image, and thus, achieving the same technical effects as the first embodiment. Further, after printing, the contents are inserted into the envelope. Then, when the discrepancy preventing tape 2 is removed, the envelope can easily be sealed via the adhesive seal 3 on the flap.

Further, in the first embodiment, while it was feared that the printed envelope could not be opened if the flap was adhered to the back surface via the adhesive on the flap during the envelope was being passed through the fixing device, in the envelope according to this embodiment, by virtue of the discrepancy preventing tape 2, such problem does not occur at all. In this way, the envelope of this embodiment is easy to use in comparison with the envelope of the first embodiment.

Figure 8A:
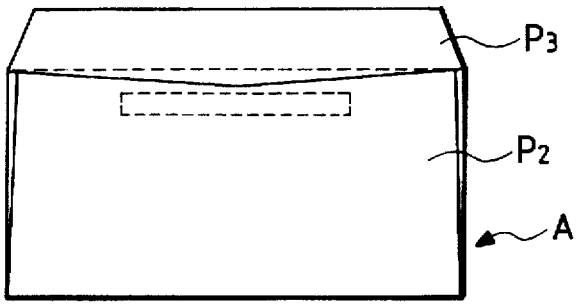
FIG. 8A is a plan view of an envelope according to a fourth embodiment of the present invention.
Figure 8B:
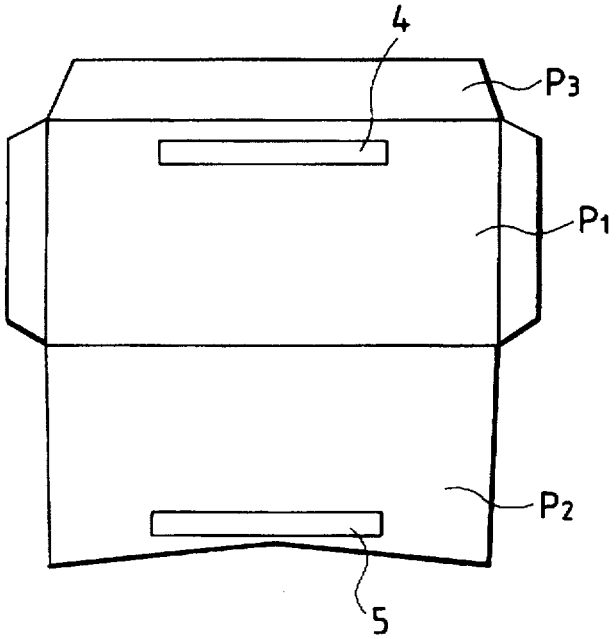
FIG. 8B is a development view of the envelope.
Figure 8C:
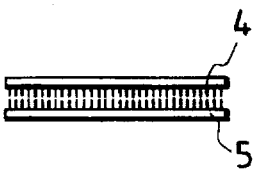
FIG. 8C is a side view of a discrepancy preventing member associated with the envelope of the fourth embodiment.

Next, a fourth embodiment of the present invention will be explained with reference to FIGS. 8A to 8C. FIG. 8A is a plan view of an envelope according to the fourth embodiment, looked at from the back side, FIG. 8B is an inner development view of the envelope, and FIG. 8C is a sectional view of discrepancy preventing members according to this embodiment.

In this embodiment, very thin "Magic Tapes" (registered trade mark) 4, 5 are provided on inner faces of the front and back surfaces of the envelope as discrepancy preventing members. As shown in FIG. 8C (enlarged view), Magic Tapes 4, 5 each have a length of about 50 mm and a width of about 10 mm and has a fine indentation surface comprised of a number of nylon fibers each having a diameter of about 0.1 mm and a height of about 0.5 mm. Although each Magic Tape has a total thickness of about 1 mm, when the Magic Tapes are closely contacted with each other, the total thickness of two Magic Tapes becomes about 1.5 mm and the Magic Tapes provide the great friction force sufficient to prevent the discrepancy between the front and back surfaces.

Also in this fourth embodiment, by virture of the Magic Tapes, there is no difference in convey amount between the front surface $P_1$ and the back surface $P_2$, thereby achieving good print quality. Thus, the discrepancy preventing means is not limited to the adhesive tapes of the first and second embodiments, but may be any member or members which can hold the front and back surfaces together to prevent the discrepancy therebetween.

Figure 9A:
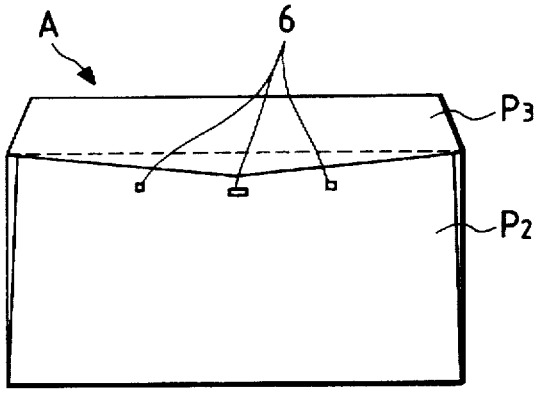
FIG. 9A is a plan view of an envelope according to a fifth embodiment of the present invention.
Figure 9B:
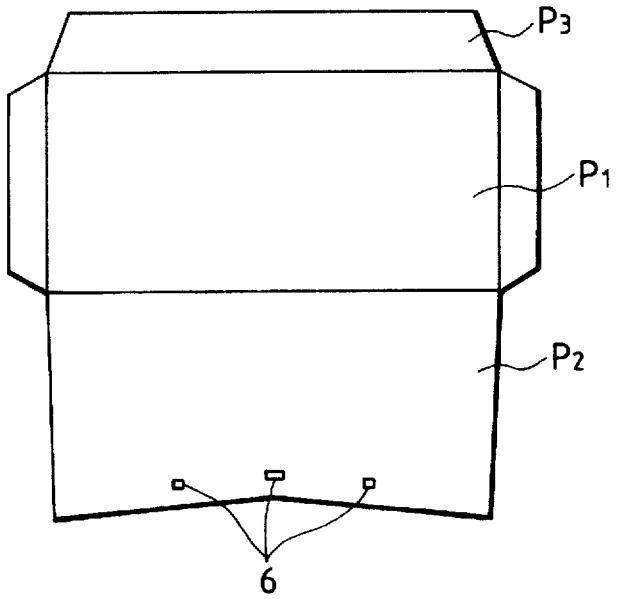
FIG. 9B is a development view of the envelope.

Next, a fifth embodiment of the present invention will be explained with reference to FIGS. 9A and 9B. FIG. 9A is a plan view of an envelope according to the fifth embodiment, looked at from the back side, and FIG. 9B is an inner development view of the envelope. In this embodiment, adhesive (which is not peelable itself) for adhering the normal paper sheets together is coated on small portions 6 (each having a square area of about 3 mm×3 mm) of an inner face of the envelope so that the front surface $P_1$ and the back surface $P_2$ are held together. In this condition, the characters are printed on the envelope. After the printing, the back surface is separated from the front surface, and then the contents are inserted into the envelope, and then the envelope is sealed.

In this embodiment, since the front surface $P_1$ and the back surface $P_2$ are held together to eliminate the difference in convey amount therebetween, the wrinkles, deviation of the image and unevenness of the image can be prevented. Further, when the front surface is separated from the back surface, since the adhesive is only coated on the small portions 6, the envelope is not damaged and good results can be obtained.

As mentioned above, when the envelope is pinched between the pair of rollers and is conveyed by the rotation of the rollers, since the roller having the low rigidity is deformed elastically, the envelope is closely contacted with the roller having the high rigidity in the arcuated form. Although the angular velocity of the inner paper portion differs from that of the outer paper portion, since the paper portions are fixed in the facial direction by the fixing means (discrepancy preventing means), the convey amounts of the paper portions becomes the same, thereby preventing the occurrence of wrinkles.

Figure 10:
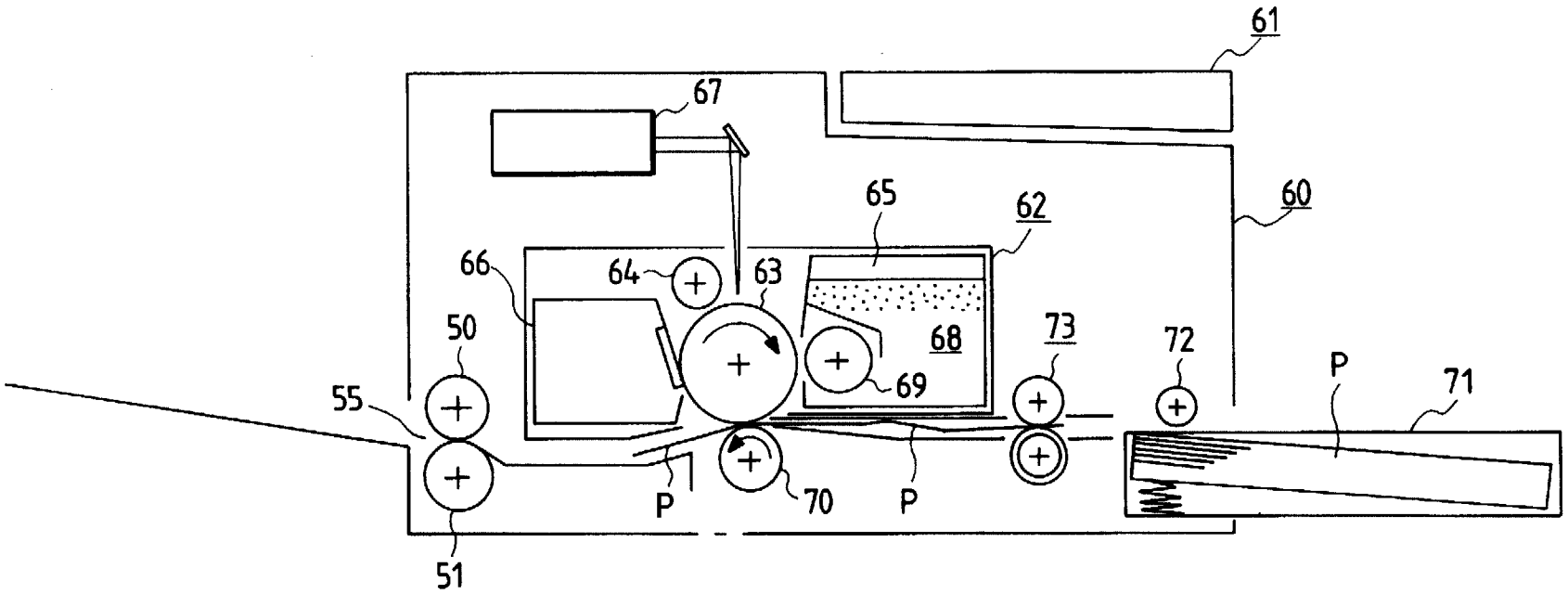
FIG. 10 is a schematic sectional view of an image forming apparatus for printing an image on the envelope according to the present invention.
Figure 11A:
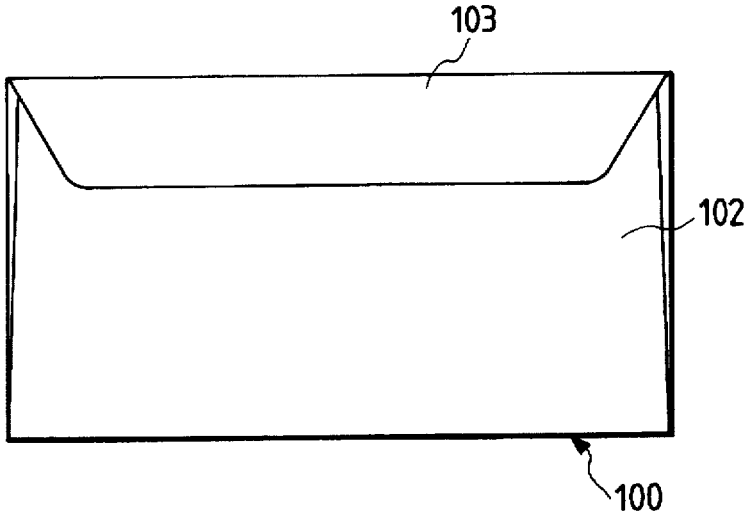
FIG. 11A is a plan view of a conventional envelope.
Figure 11B:
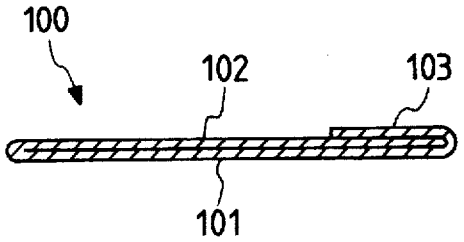
FIG. 11B is a sectional view of such envelope.
Figure 12:
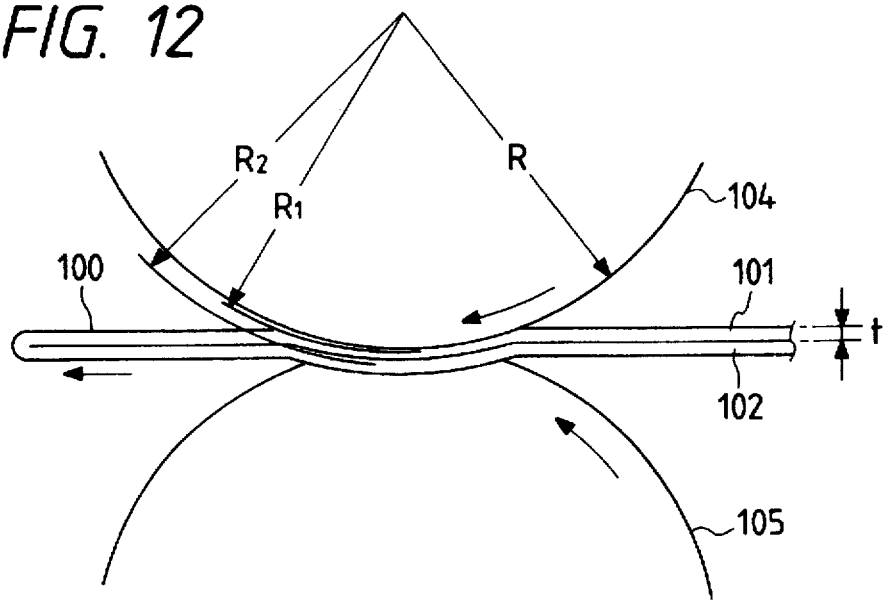
FIG. 12 is a partial sectional view showing a condition that the envelope of FIGS. 11A and 11B is being conveyed.
Figure 13A:
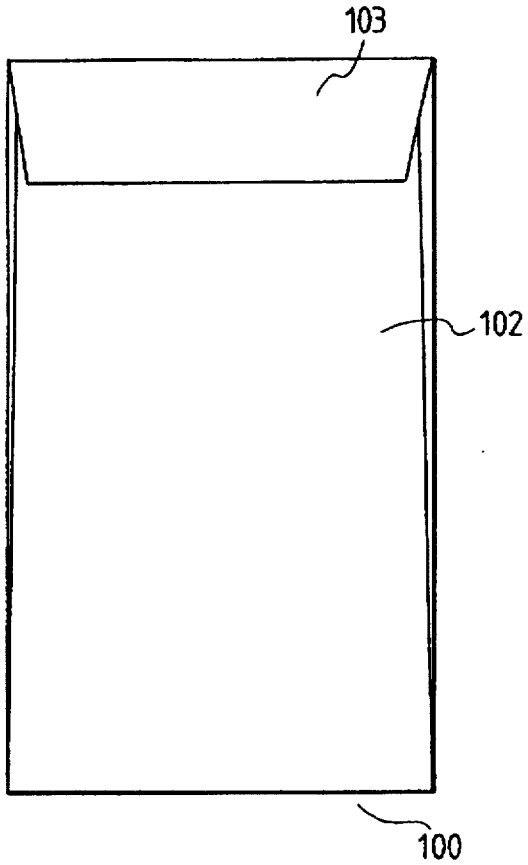
FIG. 13A is a plan view of another conventional envelope.
Figure 13B:
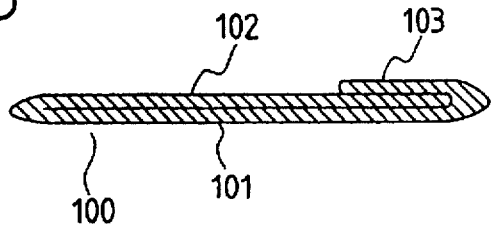
FIG. 13B is a sectional view of such envelope.
Figure 14:
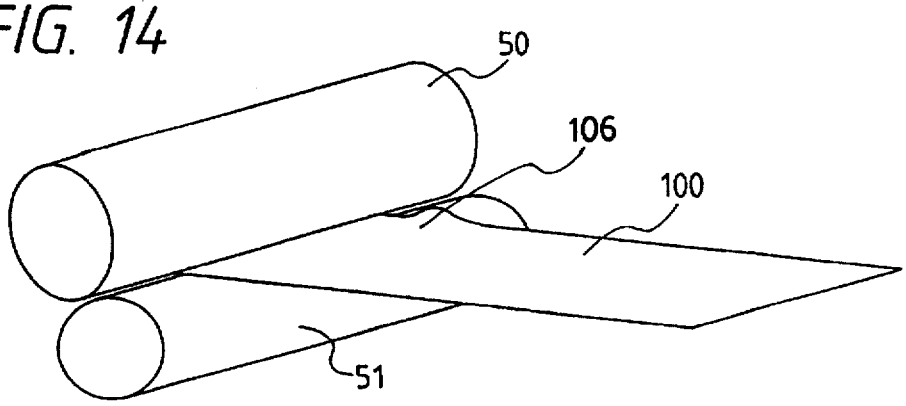
FIG. 14 is a perspective view showing a condition that the conventional envelope is being passed through a fixing device.

Lastly, an image forming apparatus for printing the characters on the envelope according to the present invention will be explained with reference to FIG. 10. For example, the image forming apparatus may be a laser beam printer of an electrophotographic process type.

The printer 60 comprises an upper lid 61 for normally closing an opening through which a process cartridge is loaded and unloaded, and a process cartridge 62 which can be removably mounted to the printer. The process cartridge 62 includes a photosensitive drum (image bearing member) 63, a primary charger 64, a developing device 65 and a cleaner 66.

For example, the photosensitive drum 63 comprises a drum base made of aluminium and an OHP photosensitive layer coated on an outer peripheral surface of the drum base, and is rotated in a clockwise direction at a predetermined process speed (peripheral speed) (50 mm/sec in the illustrated embodiment). The printer has a throughput in which eight sheets having A4 size can be treated at the maximum.

The primary charger 64 is urged against the photosensitive drum 63 with the predetermined pressure and is rotatingly driven by the rotation of the photosensitive drum 63.

When the charge bias is applied to the primary charger 64 from a high voltage source (not shown), the photosensitive drum 63 is uniformly charged negatively.

The negatively charged photosensitive drum 63 which is being rotated is scanned by laser light outputted from a laser scanner 67 in response to desired image information (which laser light is then modulated), with the result that the potential on the scanned portion of the photosensitive drum is decreased, thereby forming an electrostatic latent image corresponding to the desired image information on the photosensitive drum 63. Then, the electrostatic latent image is developed as a toner image by negative toner 68 in the inversion developing device 65. Incidentally, the developing device includes a developing sleeve 69.

Then, the toner image is transferred onto an envelope P supplied to a transfer station between the photosensitive drum 63 and a transfer roller (transfer means) 70 contacted with the drum at a predetermined timing. The transfer roller 70 is urged against the photosensitive drum 63 with a predetermined urging force and is rotated normally at a peripheral speed substantially the same as a peripheral speed of the photosensitive drum 63. Further, the transfer bias from a high voltage source (not shown) is applied to the transfer roller.

The envelopes P are stacked in an envelope cassette 71 disposed in an envelope supply station and are supplied one by one by the combination of an envelope pick-up roller 72 and a separating claw (not shown). The separated envelope is sent to the transfer station by a pair of regist rollers 73 at the predetermined timing. After the envelope passes through the transfer station, the envelope is separated from the rotating photosensitive drum 63 and then is sent to a fixing device 55, where the transferred toner image is fixed to the envelope. The fixing device 55 comprises a fixing roller 50 and a pressure roller 51. When the envelope is being passed through a nip between the rollers 50 and 51, the toner image is fixed to the envelope P with heat and pressure.

The fixing roller 50 of the fixing device 55 according to the illustrated embodiment comprises a hollow core made of aluminium and fluororesin layer coated on an outer peripheral surface of the core, and has a diameter of 20 mm. The pressure roller 51 also has a diameter of 20 mm and comprises a core made of SUS and having a diameter of 8 mm, and an elastic layer formed on the core and formed from low temperature vulcanized silicone rubber (LTV) and having a thickness of 6 mm.

After the toner image is transferred to the envelope P, residual materials such as residual toner and the like are removed from the photosensitive drum 63 by the cleaner 66 in preparation for the next image formation.

Although the image is printed on the envelope in this way, since the envelope is conveyed by several rollers from the supply of the envelope to the completion of the fixing, the envelope must has a predetermined length (longer than a maximum distance between the rollers) and must be printed along a longitudinal direction.

What is claimed is:

1. An envelope, comprising:

an envelope body including a first rectangular constructural piece and a second rectangular constructural piece having a same length as each other, which provide a back surface and a front surface, respectively, of said envelope, and which are connected to each other at one end thereof along a lengthwise periphery thereof, and form an opening at another end thereof opposite said one end along a lengthwise periphery thereof;

a first flap extended from said another end of said first rectangular constructural piece at a side of the back surface;

a second flap extended from said another end of said second rectangular constructural piece at the side of the back surface to be overlapped with said second rectangular constructural piece; and a fixing member for preventing relative movement between said first rectangular constructural piece and said second rectangular constructural piece in a direction parallel to respective surfaces thereof, said fixing member extending from said second rectangular constructural piece to said first flap.

2. An envelope according to claim 1, wherein said first rectangular constructural piece and said second rectangular constructural piece are made from an integral elongated rectangular blank by folding said integral elongated rectangular blank at an intermediate portion thereof.

3. An envelope according to claim 2, wherein said first rectangular constructural piece and said second rectangular constructural piece have different respective heights.

4. An envelope according to claim 1, wherein said fixing member is an adhesive tape that is adhered at one surface thereof to said second rectangular constructural piece, and is adhered at another surface thereof to said first flap.

* * * * *

UNITED STATES PATENT AND TRADEMARK OFFICE

CERTIFICATE OF CORRECTION

PATENT NO. : 5,707,002

DATED : January 13, 1998

INVENTOR(S) : Miyamoto et al.

It is certified that error appears in the above-identified patent and that said Letters Patent is hereby corrected as shown below:

COLUMN 1:

Line 25, "referred" should read --referred to--.
Line 47, "(drivel" should read --(drive)--.

COLUMN 3:

Line 50, "constitutes: should read --constitute--
Line 65, "rubber." should read --rubber).--.

COLUMN 4:

Line 30, "virture" should read --virtue--.
Line 65, "envelop" should read --envelope--.

COLUMN 5:

Line 46, "during" should read --while--.
Line 64, "has" should read --have--.

UNITED STATES PATENT AND TRADEMARK OFFICE

CERTIFICATE OF CORRECTION

PATENT NO. : 5,707,002

DATED : January 13, 1998

INVENTOR(S) : Miyamoto et al.

It is certified that error appears in the above-identified patent and that said Letters Patent is hereby corrected as shown below:

COLUMN 6:

Line 5, "virture" should read --virtue--.
Line 59, "aluminium" should read --aluminum--.

COLUMN 7:

Line 40, "aluminium" should read --aluminum--.

Signed and Sealed this

Twenty-eighth Day of July, 1998

*Attest:*

*Attesting Officer*

BRUCE LEHMAN

*Commissioner of Patents and Trademarks*